US008040759B2

(12) United States Patent
Chaignat

(10) Patent No.: US 8,040,759 B2
(45) Date of Patent: Oct. 18, 2011

(54) DEVICE THAT ASSISTS IN MAINTAINING THE POSITION OF A DATE INDICATOR DISC FOR A TIMEPIECE

(75) Inventor: Julien Chaignat, Le Landeron (CH)

(73) Assignee: ETA SA Manufacture Horlogère Suisse, Grenchen (CH)

( * ) Notice: Subject to any disclaimer, the term of this patent is extended or adjusted under 35 U.S.C. 154(b) by 0 days.

(21) Appl. No.: 12/604,796

(22) Filed: Oct. 23, 2009

(65) Prior Publication Data

US 2010/0103780 A1 Apr. 29, 2010

(30) Foreign Application Priority Data

Oct. 24, 2008 (EP) ..... 08167519

(51) Int. Cl.
*G04B 19/20* (2006.01)
*G04B 19/06* (2006.01)

(52) U.S. Cl. ..... 368/38; 368/233

(58) Field of Classification Search ..... 368/34–38, 368/233
See application file for complete search history.

(56) References Cited

U.S. PATENT DOCUMENTS

| | | | | |
|---|---|---|---|---|
| 3,667,211 | A * | 6/1972 | Schneider | 368/38 |
| 3,713,287 | A * | 1/1973 | Vogt et al. | 368/38 |
| 3,818,692 | A * | 6/1974 | Zaugg et al. | 368/38 |
| 3,879,929 | A * | 4/1975 | Charbonney et al. | 368/38 |
| 4,048,795 | A * | 9/1977 | Risi | 368/38 |
| 4,081,950 | A * | 4/1978 | Chappatte | 368/37 |
| 4,240,249 | A * | 12/1980 | Malkin et al. | 368/28 |
| 4,261,047 | A * | 4/1981 | Nakao | 368/38 |
| 4,271,493 | A * | 6/1981 | Tamaru et al. | 368/28 |
| 6,584,040 | B1 * | 6/2003 | Nakajima et al. | 368/28 |
| 6,744,696 | B2 * | 6/2004 | Vernay et al. | 368/37 |
| 7,782,715 | B2 * | 8/2010 | Crettex | 368/37 |
| 2002/0080686 | A1 * | 6/2002 | Rochat et al. | 368/37 |
| 2002/0159337 | A1 * | 10/2002 | Weissbach et al. | 368/37 |
| 2004/0027926 | A1 * | 2/2004 | Haselberger | 368/223 |
| 2004/0066711 | A1 * | 4/2004 | Haefeli et al. | 368/101 |
| 2006/0098535 | A1 * | 5/2006 | Marki et al. | 368/37 |
| 2007/0147177 | A1 * | 6/2007 | Zaugg et al. | 368/28 |

FOREIGN PATENT DOCUMENTS

| | | |
|---|---|---|
| CH | 491 420 | 12/1969 |
| EP | 1 962 152 | 8/2008 |
| FR | 1 485 815 | 6/1967 |

OTHER PUBLICATIONS

European Search Report issued in corresponding application No. EP 08 16 7519, completed Apr. 17, 2009.

* cited by examiner

*Primary Examiner* — Sean Kayes
(74) *Attorney, Agent, or Firm* — Griffin & Szipl, P.C.

(57) ABSTRACT

Device that assists in maintaining the position of a date indicator disc (2; 3) for a timepiece, the position of the date indicator disc (2; 3) being indexed by a jumper spring (50; 50'), said device being characterized in that it includes a locking member (52; 52') which, outside the date indication correction phases, keeps the jumper spring (50; 50') locked, said locking member (52; 52') moving away in the date indication correction phase to release the jumper spring (50; 50').

10 Claims, 7 Drawing Sheets

DEVICE THAT ASSISTS IN MAINTAINING THE POSITION OF A DATE INDICATOR DISC FOR A TIMEPIECE

This application claims priority from European Patent Application No. 08167519.1 filed Oct. 24, 2008, the entire disclosure of which is incorporated herein by reference.

FIELD OF THE INVENTION

The present invention concerns a device that assists in maintaining the position of a date indicator disc for a timepiece.

BACKGROUND OF THE INVENTION

An example embodiment of a date indicator mechanism is shown in perspective in FIG. 1 annexed to this patent application. Designated as a whole by the general reference numeral 1, this type of mechanism is for mounting in the bottom plate of a watch (not illustrated), typically a wristwatch for displaying the day of the month. Date mechanism 1 includes a top date ring 2 and a bottom date ring 3. The top date ring 2 is superposed on the bottom date ring 3. Top date ring 2 has sixteen sectors regularly distributed over its circumference. On the top face of ring 2, the sixteen sectors include successive markings that go from "17" to "31", and a window 21, which, in the example shown, is a through aperture arranged in top date ring 2. The bottom date ring 3 also has sixteen sectors regularly distributed over its circumference. On the top face of ring 3, the sixteen sectors have successive markings from "1" to "16". The watch will typically have an aperture through which the markings on top and bottom date rings 2 and 3 can be seen.

FIGS. 2 and 3 show more specifically constituent details of top and bottom date rings 2 and 3. Teeth 22 project radially towards the interior of top date ring 2 from a peripheral inner edge 23 of said top ring 2. Similarly, teeth 32 project radially towards the interior of bottom date ring 3 from an inner edge 33 thereof. Teeth 22 and 32 are regularly spaced along inner peripheral edges 23 and 33 of the respective date rings 2 and 3. Each tooth 22 is associated with a marking 24 or with window 21 of top date ring 2. Likewise, each tooth 32 is associated with a marking 34 of bottom date ring 3.

Date indicator mechanism 1 also includes a control wheel 4, which is for driving top and bottom date rings 2 and 3 and which completes one revolution in 31 days, driven by a pinion 61 that is driven onto the hour wheel, and gears 62 and 63 which will not be described further here.

FIG. 4 annexed to this patent application is a detailed perspective view of control wheel 4. As is clear from the Figure, control wheel 4 has first and second superposed toothings stages 41 and 42. On the periphery of each of stages 41 and 42 there is a portion fitted with successive adjacent teeth and a portion with no teeth. In the toothed portion of each of first and second toothing stages 41 and 42, the teeth are regularly spaced at an angle of $2\pi/31$.

As is visible in FIG. 4, a reference numeral has been added to each of the teeth of toothing stages 41 and 42, indicating which sectors of top and bottom date rings 2 and 3 is controlled by that tooth. Thus, first toothing stage 41 includes teeth that will control sectors "17" to "31" and window 21 of top date ring 2. The toothless portion of first toothing stage 41 thus extends between the tooth that controls the sector corresponding to window 21 and the tooth that controls sector "17". The second toothing stage 42 includes teeth that control sectors "1" to "16". The toothless portion of second toothing stage 42 thus extends between the tooth that controls sector "16" and the tooth that controls sector "1". The toothed portion of one stage is placed plumb with the toothless sector of the other stage. Thus, the teeth of the first toothing stage 41 controlling markings "17" to "31" of top ring 2 are arranged plumb with the toothless portion of second toothing stage 42. The toothless portion of first toothing stage 41 is placed plumb with the teeth of second toothing stage 42 that control markings "2" to "16" of bottom ring 3. By way of exception, the tooth of first toothing ring 41 which controls sector "1" of bottom date ring 3 is arranged plumb with the tooth of second toothing stage 42 that controls the sector corresponding to window 21 of top date ring 2.

First and second toothing stages 41 and 42 are coupled in rotation, such that a simple rotation of one revolution of control wheel 4 drives one or other of the two top and bottom date rings 2 and 3. First and second toothing stages 41 and 42 are arranged for respectively driving top date ring 2 and bottom date ring 3 via their toothed portions. Multiplier wheel sets 11 and 13 form a kinematic link between first and second toothing stages 41 and 42 and top and bottom date rings 2 and 3 respectively. Multiplier wheel sets 11 and 13 ensure that the daily rotation of control wheel 4 means that one date ring moves forward one step from one day of the month to the next.

FIG. 5 annexed to this patent application is a side view of the date indication corrector mechanism. As illustrated in this Figure, first toothing stage 41 is kinematically connected to top date ring 2 via first multiplier gear 11, third multiplier gear 13 and the top gear of a corrector gear train 9. Multiplier gear 11 includes a pinion 112 driven by the toothed part of first toothing stage 41. Multiplier gear 11 further includes a wheel 111 secured to pinion 112. Multiplier gear 13 includes a pinion 131 driven by wheel 111. Multiplier gear 13 further includes a wheel 132, secured to pinion 131, that drives the top gear of corrector gear train 9.

During the rotation of control wheel 4, date indicator mechanism 1 operates as follows. Let us assume that window 21 and marking "1" are initially placed underneath the watch aperture. The first day of the month is thus visible to the person wearing the watch. At the change, controlled by control wheel 4, from the first day of the month to the second, then from the second to the third and so on until the "16":

- the toothless part of first toothing stage 41 is opposite first wheel set 11. Top date ring 2 is thus not being driven and window 21 remains stationary, placed underneath the aperture of the watch;
- the teeth of second toothing stage 42, which control the movement of markings "2" to "16", will mesh in succession with second multiplier gear 12 and will thus drive bottom date ring 3, via its teeth 32. Thus, the dates "2" to "16" will be visible in succession in the watch aperture through window 21.

At the change, controlled by wheel 4, from day "16" of the month, marked on bottom date ring 3 to day "17" of the month, marked on top date ring 2 then subsequently from day "17" to "31":

- the toothless portion of second toothing stage 42 is opposite second multiplier gear 12. Bottom date ring 3 is thus not being driven and the date "16" remains stationary under the aperture;
- the teeth of first toothing stage 41, which control the movement of markings "17" to "31" will mesh in succession with wheel set 11, and thus drive top date ring 2, via its teeth 22. Thus, the dates "17" to "31" will be displayed in succession in the aperture.

At the change from the date "31" carried by top ring 2 to the date "1" carried by bottom ring 3, the tooth of first toothing stage 41, which controls the movement of window 21, and the tooth of second toothing stage 42 that controls the movement of marking "1", are simultaneously meshed with wheels sets 11 and 12 respectively, the tooth of first toothing stage 41 being superposed on the tooth of second toothing stage 42. Top date ring 2 thus pivots to place window 21 underneath the aperture, whereas bottom date ring 3 pivots to place marking "1" underneath the aperture.

An examination of FIG. 1 reveals that the position of top and bottom date rings 2 and 3 is indexed by a jumper spring 50, maintained by a spring 51. These jumper springs 50 are used for keeping date rings 2 and 3 in position and preventing them from rotating unexpectedly outside the date indication correction periods, for example via the effect of a shock. When one wishes to obtain a date mechanism with a jump duration that is as short as possible, the multiplication ratio between the control wheel and the date ring concerned must be as high as possible. Thus, the available torque at the output of the gear train that connects the control wheel to the date ring is low, such that the force exerted by the jumper spring on said date ring must be as small as possible so that it can be overcome when the date ring is made to move forward one step. However, if the retaining force exerted by the jumper spring on the date ring is low, there is a significant risk of the date ring jumping in the event of a shock and of the date indication being incorrect.

SUMMARY OF THE INVENTION

It is an object of the present invention to overcome this drawback, in addition to others, by providing a date indicator mechanism that has a high level of shock resistance outside the date indicator correction periods, while presenting only a low resistant torque during the date indication correction phases.

The present invention therefore concerns a device that assists in maintaining the position of a date indicator disc for a timepiece, wherein the position of the date indicator disc is indexed by a jumper spring, and said device is characterized in that it includes a locking member, which, outside date indication correction periods, keeps the jumper spring locked, and wherein said locking member moves aside in the date indication correction phase to release the jumper spring.

Owing to these features, the present invention provides a date indicator mechanism whose date disc is kept locked outside date indication correction phases and is released and just kept indexed by a jumper spring during date indication correction phases. It is thus ensured that, during normal operation of the watch, the date indicator disc is firmly held and is not liable to pivot unexpectedly via the effect of a shock, for example. The date indication provided by the watch fitted with the date mechanism according to the invention is thus always reliable. However, close to midnight, when the date indication has to change, the date disc is held only by the jumper spring, which presents a low resistant torque. The available torque at the output of the gear train that connects the control wheel to the date ring does not, therefore, need to be high, such that the multiplication ratio between said control wheel and said date ring may be large. A date mechanism is thus obtained which has a quicker jump than that of a drag mechanism and which is close to an instantaneous jump mechanism.

According to a complementary feature of the invention, in the date indication correction phase, the locking member is moved away from its jumper spring locking position by an actuation member, which is in turn driven by a gear train that kinematically connects a control wheel to the date indicator disc.

Owing to this other feature, the jumper spring is only released from its locking position at the exact moment at which the date indication corrector train starts to work, which only occurs once every twenty-four hours during a small time period close to midnight and during manual date correction phases. Thus, for most of the time, the date disc is perfectly immobilised and is not therefore liable to jump unexpectedly, for example in the event of a shock.

According to yet another feature of the invention, outside the date indication correction phases, the locking member is locked between the jumper spring and the actuation member.

Other features and advantages of the present invention will appear more clearly in the following detailed description of an embodiment of the date mechanism according to the invention, this example being given purely by way of non-limiting illustration with reference to the annexed drawing, in which:

DETAILED DESCRIPTION OF THE PREFERRED EMBODIMENTS

Figure 1:
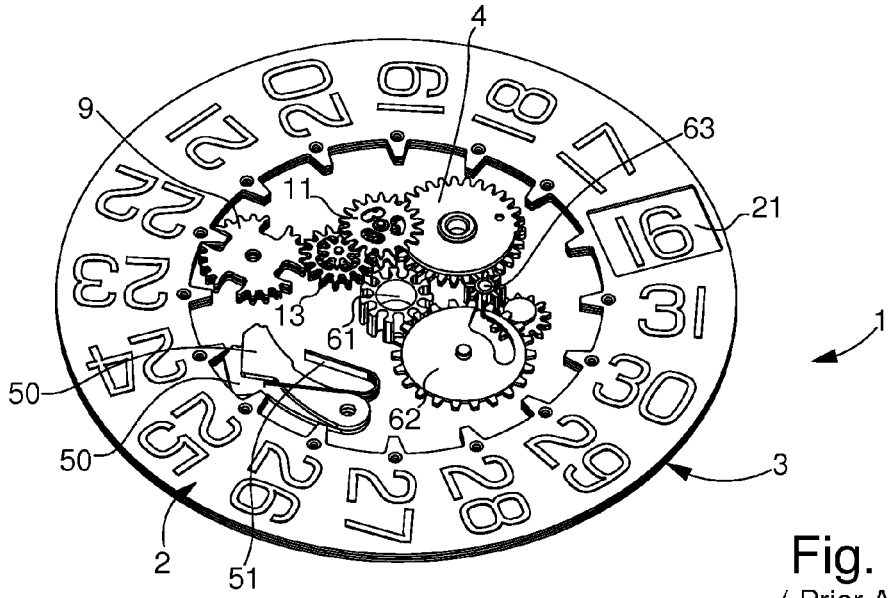
Fig. 1 ( Prior Art )
FIG. 1, already cited, is a perspective view of an example embodiment of a date indictor mechanism, FIG. 2, already cited, is a perspective view of a top date ring, FIG. 3, already cited, is a perspective view of a bottom date ring, FIG. 4, already cited, is a perspective view of a control wheel, FIG. 5, already cited, is a side view of a multiplication mechanism coupled to the control wheel.
Figure 2:
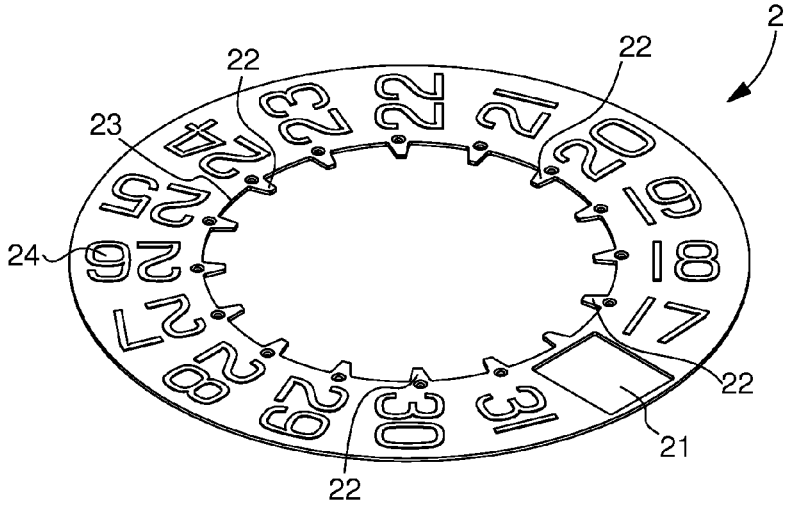
Fig. 2 ( Prior Art )
Figure 3:
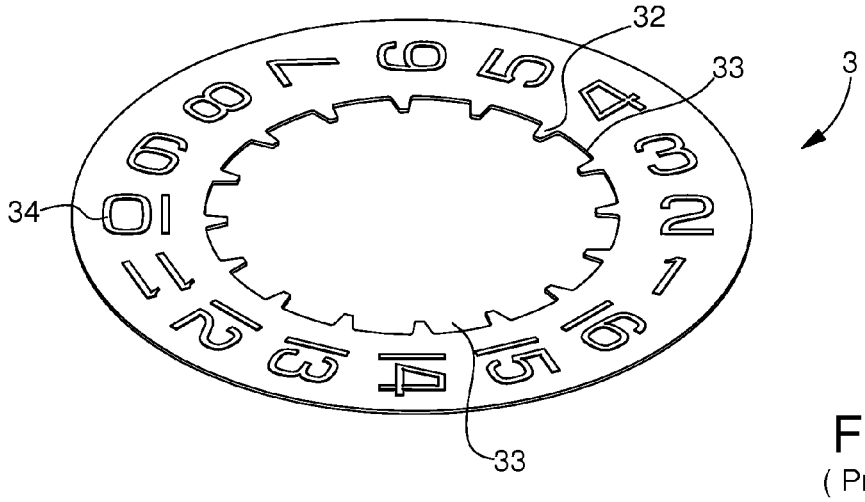
Fig. 3 ( Prior Art )
Figure 4:
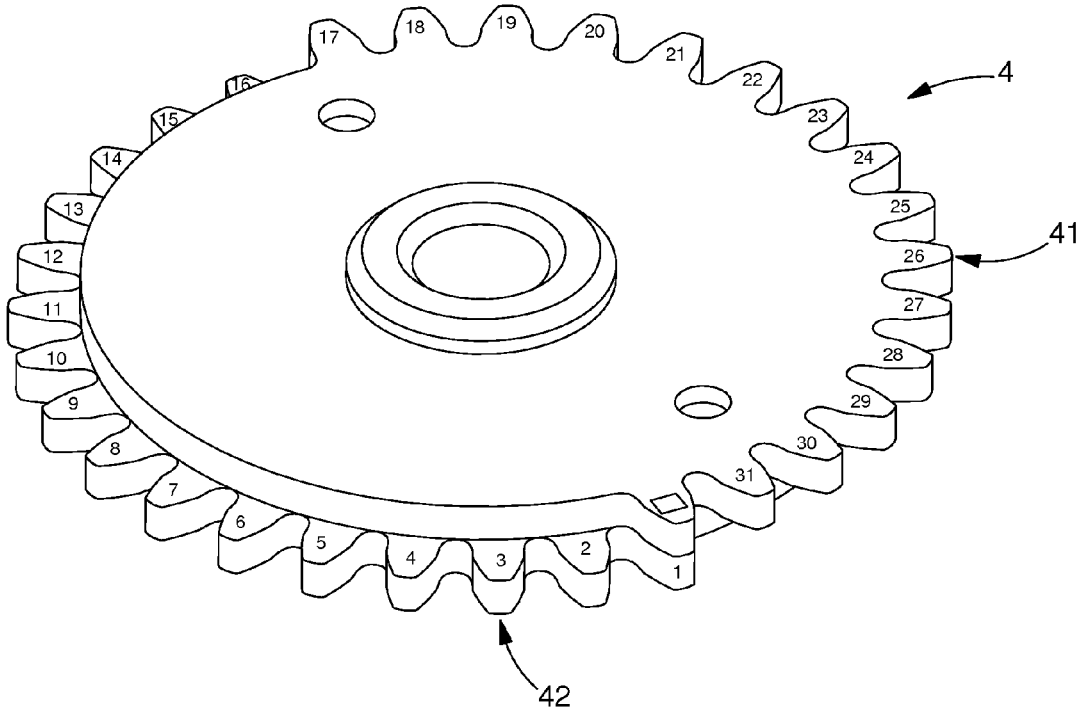
Fig. 4 ( Prior Art )
Figure 5:
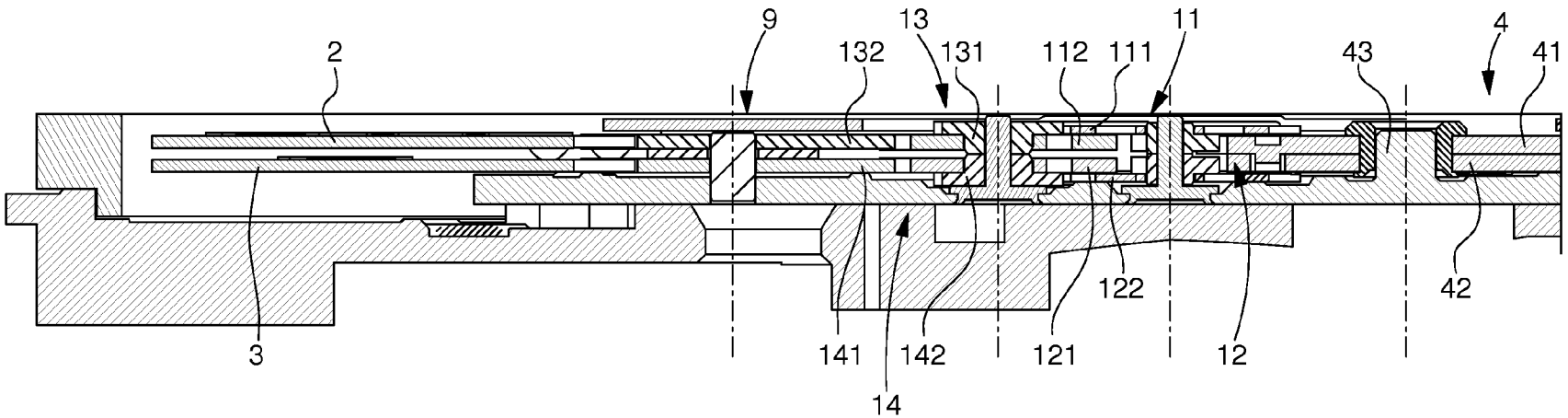
Fig. 5 ( Prior Art )

The present invention proceeds from the general inventive idea, which consists in reconciling two objects which, at first sight, appear antagonistic, namely providing a date mechanism whose date indicator disc is firmly held to prevent it from pivoting in the event of a shock and from providing an erroneous date indication, yet presents the lowest possible resistant torque during correction, so that it can move forward one step in a relatively short time due to a gear train that has a high multiplication ratio. This dual object is achieved via the use of a member that locks the date indicator disc by acting on its jumper spring outside date indication correction periods. This member is moved away from the position in which it locks the date indictor disc during the phases when the date indication is being corrected.

The present invention will now be described with reference to a date indicator mechanism that includes two superposed date discs. It goes without saying that the present invention applies in identical fashion to a date indicator mechanism that has only one date disc, divided into 31 sectors, on which the date indications from "1" to "31" are marked.

For the sake of clarity, the locking mechanism according to the invention will be described with reference to top date ring 2. It is clear that the locking mechanism associated with bottom date ring 3 is identical to that of top ring 2.

As already explained above, top and bottom date rings 2 and 3 are kinematically connected to control wheel 4 via a date indication correction train that includes multiplier wheel sets 11 and 13, and 12 and 14 respectively, and corrector wheel set 9. More specifically, top date ring 2 is driven by first toothing stage 41 of control wheel 4 via first multiplier wheel set 11, third multiplier wheel set 13 and the top gear of corrector wheel set 9. Multiplier gear 11 includes pinion 112 driven by the toothed part of first toothing stage 41. Wheel 111, coaxially secured to pinion 112, drives pinion 131 of third multiplier wheel set 13. Finally, wheel 132, coaxially secured to pinion 131, drives the top gear of corrector wheel set 9 which in turn drives top date ring 2. As can be seen upon examining FIG. 6, the position of top date ring 2 is indexed by jumper spring 50, held by one arm 51*a* of spring 51.

We are seeking to obtain the most rapid possible date indication jump from one given date to the next. The multiplication ratio between control wheel 4 and top date ring 2, via first multiplier wheel set 11, third multiplier wheel set 13 and the top gear of corrector wheel set 9, must therefore be as high as possible. Provided that this condition is checked and with an angle of two date steps of 22.5°, which is the value for a two disc date indicator mechanism, the change of date occurs in approximately 40 minutes. This is the usual jump duration of a semi-instantaneous date indicator mechanism with a single disc, and this duration is reduced to 20 minutes for a single disc date indicator mechanism owing to the present invention. The date mechanism of the invention can thus be classed in the category of semi-instantaneous date mechanisms, between drag date and instantaneous date mechanisms. It is thus possible, by making the date indication correction train a suitable size, to obtain a date mechanism wherein the date change is quicker than in the past but, as a result, the available torque at the end of the correction train by the top gear of corrector wheel set 9 is relatively low. It is thus necessary to choose a jumper spring 50 which exerts a sufficiently weak retaining force on top date ring 2 that it can be overcome by the top gear of corrector wheel set 9 in the date indication correction phase. It will immediately be understood that, in such case, the hold that jumper spring 50 exerts on top date ring 2 is not infallible and there is a significant risk of the date ring jumping in the event of large shocks.

It is an object of the present invention to overcome this problem by providing a device that assists in maintaining the position of a date ring, which, in the normal operating phase of the watch, i.e. outside periods when the date indication is being corrected, ensures that the date ring has excellent shock resistance, while allowing the date indication to be corrected with minimum torque. The present invention thus teaches adding a locking member to the date indicator mechanism. Outside date indication correction periods, the locking member holds the jumper spring locked and moves away in the date indication correction phase to release the jumper spring. In the example embodiment shown in FIG. 6, this locking member, designated as a whole by the general reference number 52, takes the form of a lever whose pivoting axis merges with its central axis of symmetry. More specifically, locking lever 52 has two, diametrically opposite arms 53*a* and 53*b*, via which it abuts both against jumper spring 50 and against an actuation member 54, which is itself actuated by the date indication correction train. In the example shown in the drawing, this actuation member 54 is formed by wheel 132 of the third multiplier wheel set 13. Of course, this example is given purely by way of illustration and it could be envisaged that locking lever 52 abuts directly, or via an intermediate element, against another wheel of the date indication correction wheel set.

It can be seen that arm 53*b* of locking lever 52 is held applied against the teeth of wheel 132 by an arm 51*b* of spring 51, which is integral with arm 51*a* thereof. Of course, one could envisage providing two distinct springs for holding jumper spring 50 and locking lever 52 respectively. It can also be seen that jumper spring 50 includes a hollow 56 for facilitating the abutment of arm 53*a* of locking lever 52.

Figure 7A:
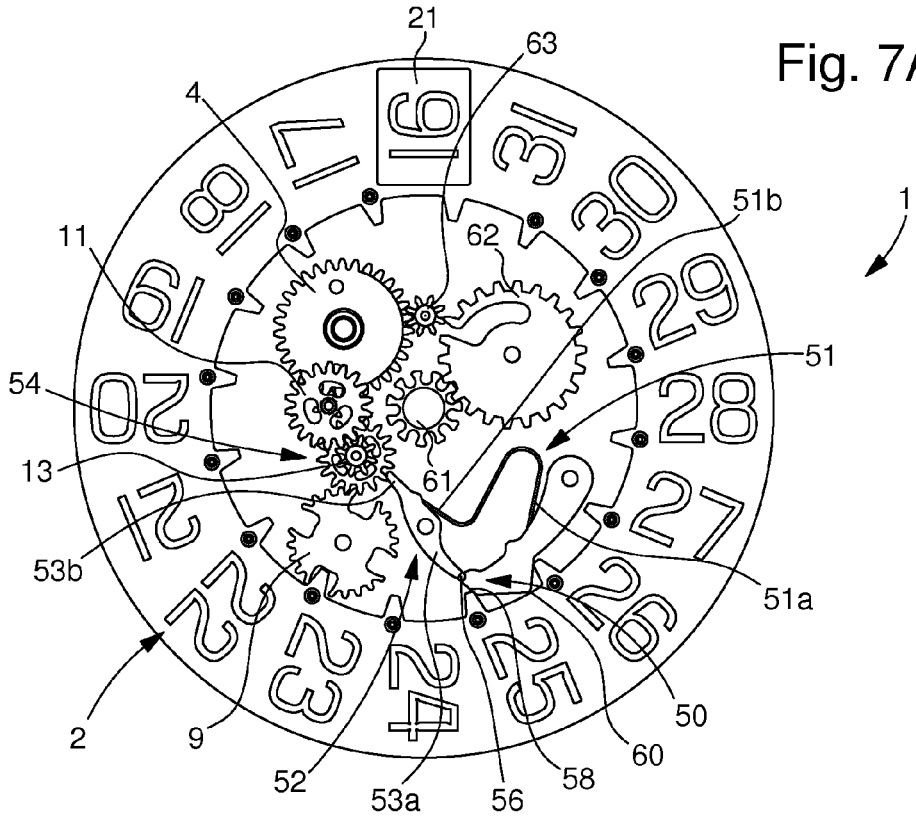
FIGS. 7A to 7F illustrate the operating principle of the locking device according to the invention.
Figure 7B:
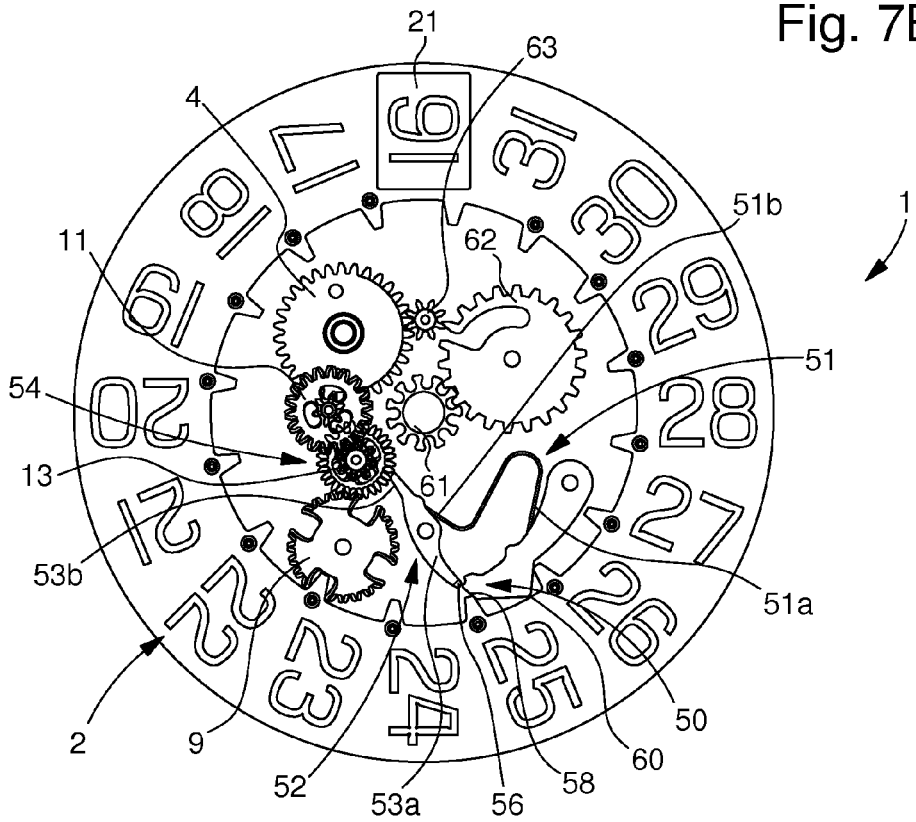
Figure 7C:
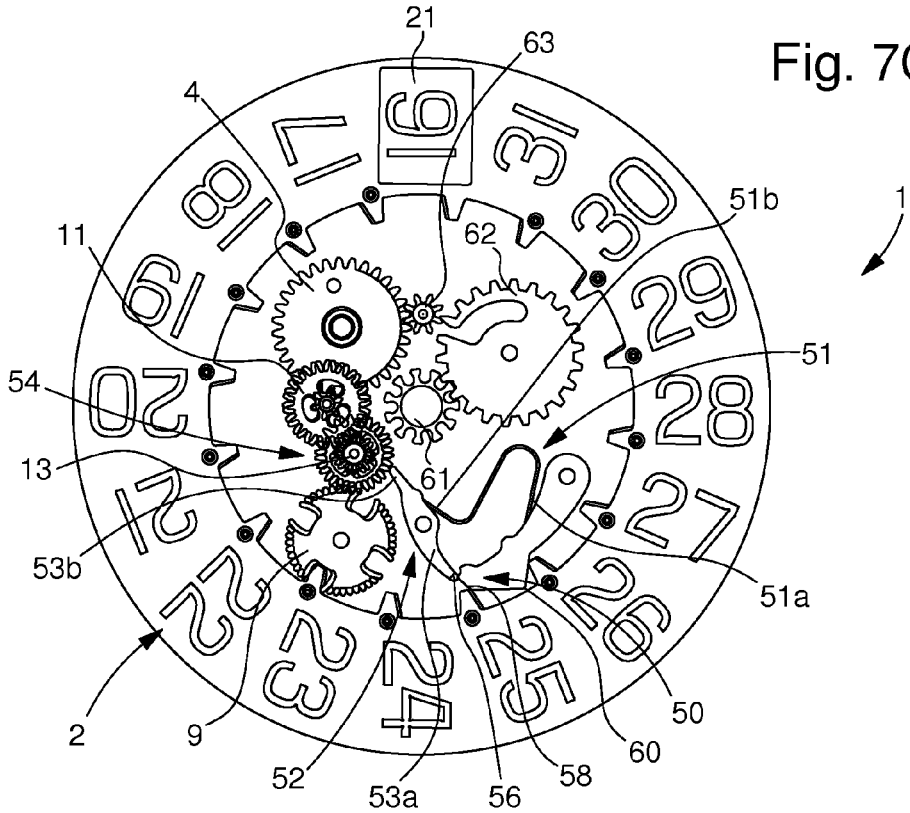

The working of the device that assists in maintaining the date ring position according to the invention will now be examined with reference to FIGS. 7A to 7F. In the normal operating period of the watch, i.e. outside phases in which the date indication is being corrected, locking lever 52 is locked between wheel 132 of third multiplier wheel set 13 and jumper spring 50, which it holds firmly pressed against top date ring 2. As multiplier wheel set 13 and top date ring 2 are both stationary, there is no risk of said top date ring 2 moving in the event of a shock. Shortly before midnight, the watch enters the date indication correction phase and control wheel 4 starts to rotate (FIG. 7A). As locking lever 52 is held against wheel 132 of third multiplier wheel set 13 by arm 51*b* of spring 51, there is no play between lever 52 and wheel 132. However, play does exist between wheel 132 and the top gear of corrector wheel set 9 and between the top gear of corrector wheel set 9 and top date ring 2 and these plays are added to each other. Consequently, when control wheel 4, and thus wheel 132 of third multiplier wheel set 13, start to rotate, said wheel 132 will first of all drive locking lever 52, before driving corrector wheel set 9 and date ring 2. In doing so, wheel 132 will move lever 52 away from its locking position against the return force of arm 51*b* of spring 51 and will thus release jumper spring 50 (FIG. 7B). Immediately after having moved lever 52 away from the position in which it locks jumper spring 50, wheel 132 starts to rotate date ring 2 via the top gear of corrector wheel set 9. From this moment on (see FIG. 7C), it is jumper spring 50 that becomes the control member for locking lever 52. It will be observed at this stage that arm 53*a* of locking lever 52 has exited the hollow 56 provided on jumper spring 50, and is sliding against a straight side 58 of said jumper spring 50, which is in the extension of said hollow 56. Thus, when date ring 2, driven by the top gear of corrector wheel set 9, starts to rotate, jumper spring 50 pivots, in turn, to pass from the gap between two teeth 22 of the top toothing of date ring 2, in which it is located, to the next gap, passing over the tooth 22 that separates the two gaps. While pivoting, jumper spring 50 causes locking lever 52 to pivot clockwise, i.e. in the same direction as the direction in which wheel 132 causes it to pivot, against the return force of arm 51*b* of spring 51 which tends to return said lever 52 to the position in which it locks jumper spring 50.

Figure 7D:
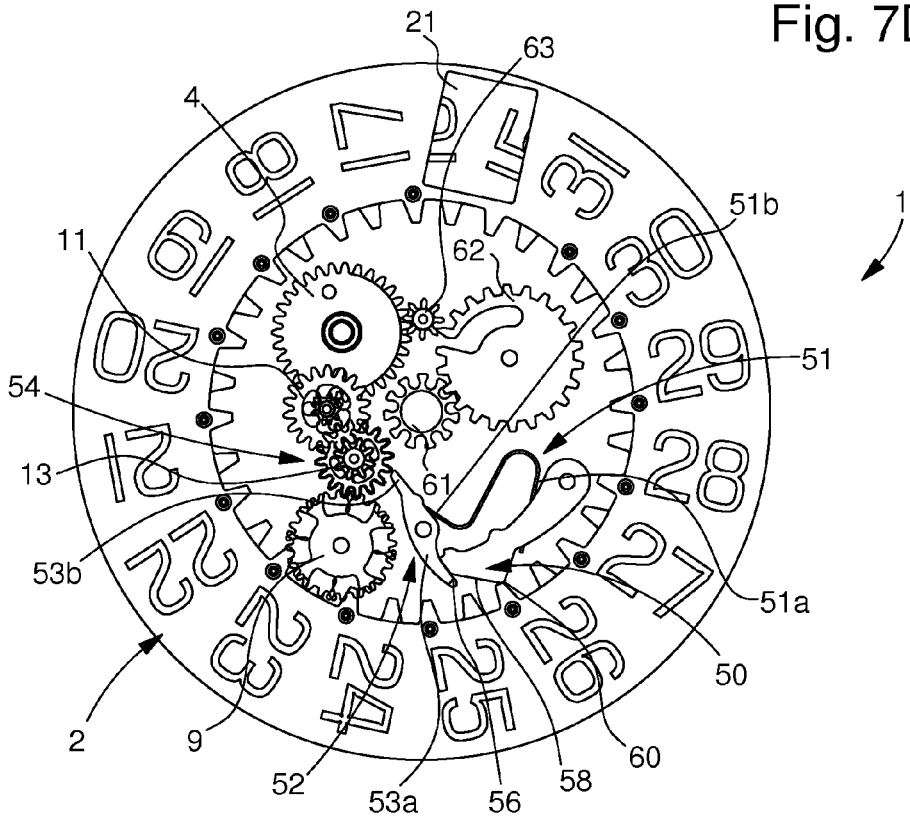

In FIG. 7D, the date mechanism according to the invention is shown in the position that immediately precedes the change of the date indication from a given day of the month, in this case day "16", to the next day, here "17". It can be seen in this Figure that jumper spring 50 is abutting, via its heel, on the tooth 22 of the inner toothing of date ring 2 that separates the gap between two teeth 22 in which said jumper spring 50 was located, from the next gap into which said jumper spring 50 will fall. Additionally, jumper spring 50 keeps lever 52 away from the rest position in which it locks said jumper spring 50.

Figure 7E:
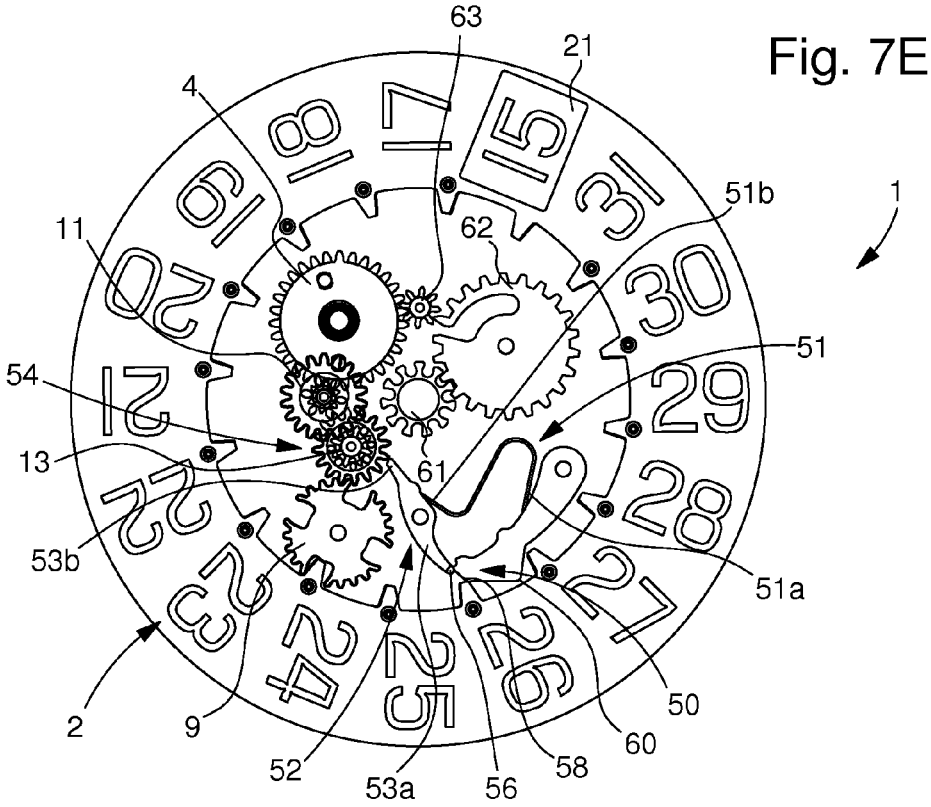
Figure 7F:
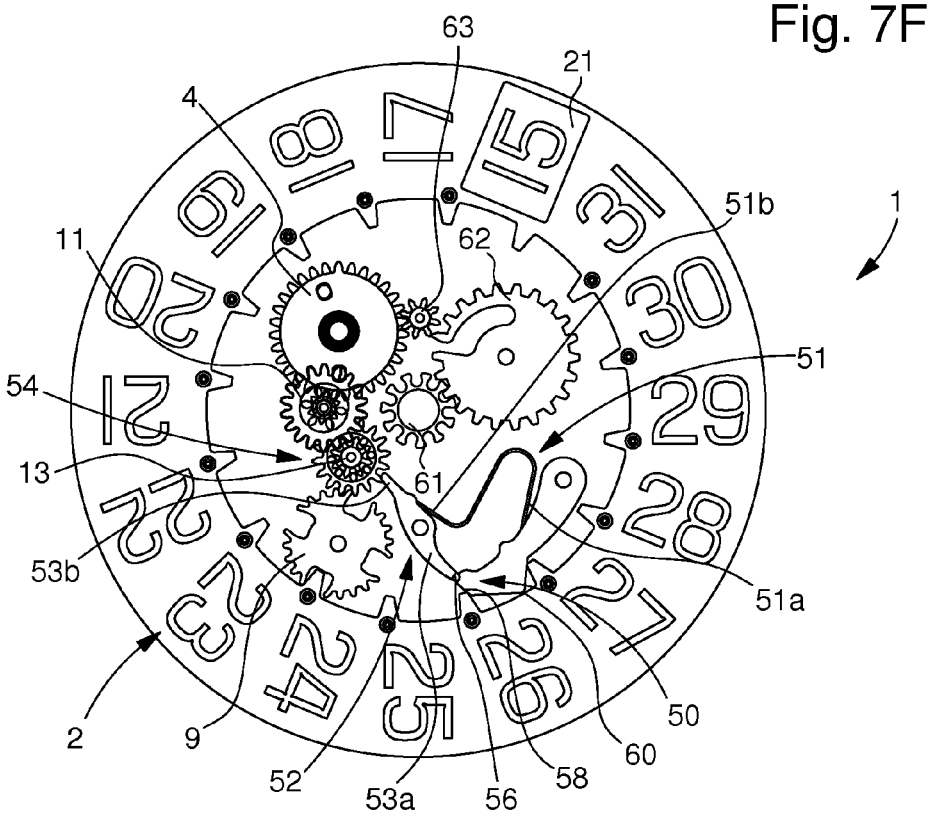

As we pass from FIG. 7D to FIG. 7E, the top gear of corrector wheel set 9 has finished moving top date ring 2 forward and jumper spring 50 has fallen into the gap between the next two teeth 22 under the effect of the elastic return force of arm 51*a* of spring 51. During its jump, jumper spring 50 becomes the drive element for date ring 2, which finishes pivoting and which is limited in its forward movement by heel 60 of said jumper spring 50, whose inclined planes come into contact with the next two teeth 22. Simultaneously, locking lever 52 rises along the side 58 of jumper spring 50. In FIG. 7F, which shows the date mechanism according to the invention after the date jump, the end of arm 53*b* of locking lever 52 has returned inside hollow 56 of jumper spring 50, thus locking said spring again.

It can be observed, in light of the foregoing, that top date ring 2 is constantly locked and that it therefore has a high level of shock resistance and is not liable to jump unexpectedly. More specifically, during the normal operating phases of the watch, top date disc 2 is held in the locking position by locking lever 52 and during the date indication correction phases, date disc 2 is held by the top gear of the corrector wheel set 9.

Figure 6:
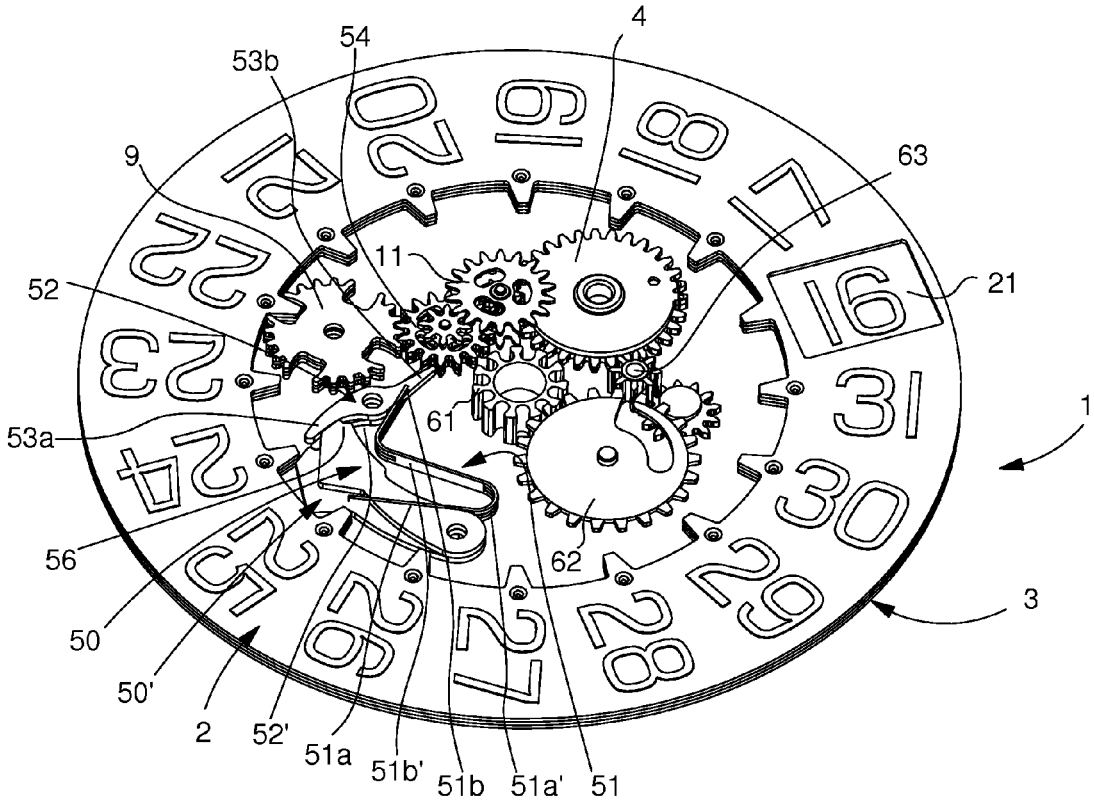
FIG. 6 is a perspective view of the date indicator mechanism shown in FIG. 1 fitted with the locking device according to the invention.

In the above description, we were concerned with top date ring 2. The present invention applies in identical fashion to bottom date ring 3. There is therefore provided a locking lever 52' arranged underneath locking lever 52 and pivotably mounted about the same axis as the latter. This locking lever 52' cooperates with wheel 122 of the fourth multiplier gear 14 and with a jumper spring 50' mounted underneath jumper spring 50 and pivoting about the same axis as the latter. Locking lever 52' is held against wheel 122 by a spring 51*b*' and jumper spring 50' is held in a position indexing bottom date ring 3 by a spring 51*a*'. The two springs 51*b*' and 51a' may be separate or integral with each other. One could also envisage, as shown in FIG. 6, the four springs 51*a*, 51*a*', 51*b* and 51*b*' being made in a single part in the form of pairs of parallel elastic strips.

What is claimed is:

1. A timepiece having a device that assists in maintaining a position of a date indicator disc, comprising:

a date indicator disc;

a jumper spring arranged to index a position of the date indicator disc;

a locking lever movable between a first position and a second position, wherein, in the first position, outside a date indication correction phase, the locking lever is positioned to lock the jumper spring, and wherein, in the second position, in the date indication correction phase, the locking lever is disposed away from the first position to release the jumper spring;

a control wheel that completes one revolution in 31 days;

a gear train kinematically connecting the control wheel to the date indicator disc; and a toothed wheel, driven by the gear train, and disposed to move the locking lever between the first position and the second position, wherein the locking lever comprises two diametrically opposite arms, one of which abuts against the jumper spring and the other of which abuts against the toothed wheel.

2. The timepiece according to claim 1, wherein, in the first position, the locking lever is positioned to lock between the jumper spring and the toothed wheel.

3. The timepiece according to claim 2, further comprising a spring member having an arm, wherein the locking lever is held against the toothed wheel by the arm of the spring member, so that there is no play between the locking lever and the toothed wheel.

4. The timepiece according to claim 3, further comprising an elastic arm integral with the arm of the spring member, wherein the jumper spring is held in the indexed position of the date indicator disc by the elastic arm.

5. The timepiece according to claim 1, further comprising a spring member having an arm, wherein the locking lever is held against the toothed wheel by the arm of the spring member, so that there is no play between the locking lever and the toothed wheel.

6. The timepiece according to claim 5, further comprising an elastic arm integral with the arm of the spring member, wherein the jumper spring is held in the indexed position of the date indicator disc by the elastic arm.

7. The timepiece according to claim 5, wherein in the first position, the end of the arm of the locking lever abutting against the jumper spring is disposed in a hollow made in the jumper spring.

8. The timepiece according to claim 7, wherein in the second position, the locking lever is driven in rotation by the toothed wheel against the return force of the spring member, and the locking lever is disposed away from the first position to slide via the arm of the locking lever along a straight side of the jumper spring, which is in an extension of the hollow, so that the jumper spring, forced to pivot by the date indicator disc, becomes a control member for the locking lever.

9. A timepiece having a device that assists in maintaining a position of a first date indicator disc or a second date indicator disc, comprising:

a first date indicator disc;

a second date indicator disc;

a first jumper spring arranged to index a position of the first date indicator disc;

a second jumper spring arranged to index a position of the second date indicator disc;

a first locking lever movable between a first position and a second position, wherein, in the first position, outside a date indication correction phase, the first locking lever is positioned to lock the first jumper spring, and wherein, in the second position, in the date indication correction phase, the first locking lever is disposed away from the first position to release the first jumper spring;

a second locking lever movable between a first position and a second position, wherein, in the first position, outside a date indication correction phase, the second locking lever is positioned to lock the second jumper spring, and wherein, in the second position, in the date indication correction phase, the first locking lever is disposed away from the first position to release the first jumper spring;

a control wheel that completes one revolution in 31 days;

a first gear train kinematically connecting the control wheel to the first date indicator disc;

a second gear train kinematically connecting the control wheel to the second date indicator disc;

a first toothed wheel, driven by the first gear train, and disposed to move the first locking lever between the first position and the second position; and a second toothed wheel, driven by the second gear train, and disposed to move the second locking lever between the first position and the second position, wherein the first locking lever comprises two diametrically opposite arms, one of which abuts against the first jumper spring and the other of which abuts against the first toothed wheel, wherein the second locking lever comprises two diametrically opposite arms, one of which abuts against the second jumper spring and the other of which abuts against the second toothed wheel, wherein the timepiece further comprises a first spring member having one arm, wherein the first locking lever is held against the first toothed wheel by the arm of the first spring member, so that there is no play between the first locking lever and the first toothed wheel; and a second spring member having one arm, wherein the first locking lever is held against the second toothed wheel by the arm of the second spring member, so that there is no play between the second locking lever and the second toothed wheel, wherein the first spring member and the second spring member are made in a single part.

10. A timepiece having a device that assists in maintaining a position of a first date indicator disc or a second date indicator disc, comprising:

a first date indicator disc;

a second date indicator disc;

a first jumper spring arranged to index a position of the first date indicator disc;

a second jumper spring arranged to index a position of the second date indicator disc;

a first locking lever movable between a first position and a second position, wherein, in the first position, outside a date indication correction phase, the first locking lever is positioned to lock the first jumper spring, and wherein, in the second position, in the date indication correction phase, the first locking lever is disposed away from the first position to release the first jumper spring;

a second locking lever movable between a first position and a second position, wherein, in the first position, outside a date indication correction phase, the second locking lever is positioned to lock the second jumper spring, and wherein, in the second position, in the date indication correction phase, the first locking lever is disposed away from the first position to release the first jumper spring;

a control wheel that completes one revolution in 31 days;

a first gear train kinematically connecting the control wheel to the first date indicator disc;

a second gear train kinematically connecting the control wheel to the second date indicator disc;

a first toothed wheel, driven by the first gear train, and disposed to move the first locking lever between the first position and the second position; and a second toothed wheel, driven by the second gear train, and disposed to move the second locking lever between the first position and the second position, wherein the first locking lever comprises two diametrically opposite arms, one of which abuts against the first jumper spring and the other of which abuts against the first toothed wheel, wherein the second locking lever comprises two diametrically opposite arms, one of which abuts against the second jumper spring and the other of which abuts against the second toothed wheel, wherein the timepiece further comprises a first spring member having one arm, wherein the first locking lever is held against the first toothed wheel by the arm of the first spring member, so that there is no play between the first locking lever and the first toothed wheel;

a second spring member having one arm, wherein the first locking lever is held against the second toothed wheel by the arm of the second spring member, so that there is no play between the second locking lever and the second toothed wheel;

a first elastic arm integral with the arm of the first spring member, wherein the first jumper spring is held in the indexed position of the first date indicator disc by the first elastic arm; and a second elastic arm integral with the arm of the second spring member, wherein the second jumper spring is held in the indexed position of the second date indicator disc by the second elastic arm, wherein the first spring member and the second spring member are made in a single part.

* * * * *